US011692415B2

(12) United States Patent
Zahur et al.

(10) Patent No.: US 11,692,415 B2
(45) Date of Patent: Jul. 4, 2023

(54) HYDROCARBON WELL STIMULATION BASED ON SKIN PROFILES

(71) Applicant: Saudi Arabian Oil Company, Dhahran (SA)

(72) Inventors: Jawad Zahur, Abqaiq (SA); Mohammed Mugharbil, Khobar (SA); Ayedh Al-Shehri, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 380 days.

(21) Appl. No.: 16/907,701

(22) Filed: Jun. 22, 2020

(65) Prior Publication Data

US 2021/0396104 A1 Dec. 23, 2021

(51) Int. Cl.
*E21B 37/06* (2006.01)
*E21B 43/12* (2006.01)

(52) U.S. Cl.
CPC ..... *E21B 37/06* (2013.01); *E21B 43/12* (2013.01); *E21B 2200/20* (2020.05)

(58) Field of Classification Search
CPC ..... E21B 37/06; E21B 43/25; E21B 43/28; E21B 2200/20
See application file for complete search history.

(56) References Cited

U.S. PATENT DOCUMENTS

| | | | |
|---|---|---|---|
| 5,970,422 | A | 10/1999 | Brady et al. |
| 5,992,519 | A | 11/1999 | Ramakrishnan et al. |
| 6,842,700 | B2 | 1/2005 | Poe |
| 7,739,089 | B2 | 6/2010 | Gurpinar et al. |

(Continued)

FOREIGN PATENT DOCUMENTS

| | | | |
|---|---|---|---|
| CN | 101560879 | A | 10/2009 |
| CN | 104989385 | A | 10/2015 |

(Continued)

OTHER PUBLICATIONS

Sylvester et al "A Method for Stimulation Candidate Well Selection", Jan. 2015, International Journal of Engineering & Technology, vol. 5 No. 1, 26-33 (Year: 2015).*

(Continued)

*Primary Examiner* — Tara Schimpf
(74) *Attorney, Agent, or Firm* — Bracewell LLP; Constance G. Rhebergen; Brian H. Tompkins

(57) ABSTRACT

Techniques for developing a hydrocarbon well that include: determining a skin increase threshold; collecting historical production data for hydrocarbon wells; determining, based on the data, skin profiles for the wells; identifying, in response to changes in skin that exceed the threshold, wells as candidates for stimulation; for each of the candidate wells: determining an observed production rate; determining a predicted production rate that corresponds to a skin of zero; determining a cost of stimulation to remediate the well; determining, based on the observed and predicted production rates, a predicted increase in production attributable to stimulation; and determining, based on the cost of stimulation and the predicted increase, a marginal production cost (Continued)

for increased production; selecting, based on the marginal production costs of the candidate wells, a well to be stimulated; and conducting a stimulation of the well selected.

18 Claims, 6 Drawing Sheets

(56) References Cited

U.S. PATENT DOCUMENTS

| | | | |
|---|---|---|---|
| 7,813,935 | B2 | 10/2010 | Chitty et al. |
| 8,612,194 | B2 | 12/2013 | Horne et al. |
| 8,620,636 | B2 | 12/2013 | Zhan et al. |
| 8,688,426 | B2 | 4/2014 | Al-Shammari |
| 8,738,342 | B2 | 5/2014 | Lind et al. |
| 8,914,268 | B2 | 12/2014 | Dale et al. |
| 9,022,140 | B2 | 5/2015 | Marx et al. |
| 9,085,966 | B2 | 7/2015 | Rahman et al. |
| 9,262,561 | B2 | 2/2016 | Likanapaisal |
| 9,471,730 | B2 | 10/2016 | Adeniji et al. |
| 9,617,839 | B2 | 4/2017 | Modavi et al. |
| 10,221,659 | B2 | 3/2019 | Baranov et al. |
| 10,577,894 | B1 | 3/2020 | Basu et al. |
| 2009/0276156 | A1 | 11/2009 | Kragas et al. |
| 2010/0023269 | A1 | 1/2010 | Yusti et al. |
| 2010/0133005 | A1 | 6/2010 | Bell et al. |
| 2011/0022368 | A1 | 1/2011 | Huang et al. |
| 2011/0257577 | A1 | 10/2011 | Lane et al. |
| 2014/0182841 | A1 | 7/2014 | Lecerf et al. |
| 2015/0345267 | A1 | 12/2015 | Modavi et al. |
| 2016/0312552 | A1 | 10/2016 | Early et al. |
| 2017/0292377 | A1 | 10/2017 | Ramakrishnan |
| 2018/0094517 | A1 | 4/2018 | Foubert et al. |
| 2018/0240021 | A1 | 8/2018 | Al-Harbi et al. |
| 2018/0320512 | A1 | 11/2018 | Anisur Rahman et al. |
| 2019/0179988 | A1 | 6/2019 | Malik et al. |
| 2019/0323323 | A1 | 10/2019 | Zhang et al. |
| 2020/0325889 | A1* | 10/2020 | Aditya ..... F04B 47/12 |
| 2021/0270109 | A1 | 9/2021 | Wasden |

FOREIGN PATENT DOCUMENTS

| | | | |
|---|---|---|---|
| CN | 109469478 | A | 3/2019 |
| CN | 110593860 | A | 12/2019 |
| WO | 2017223483 | A1 | 12/2017 |
| WO | 2019117901 | A1 | 6/2019 |

OTHER PUBLICATIONS

Nnanna et al "Important Considerations in Matrix Stimulation Candidate Selection in Niger Delta", 2009, SPE 128604, 1-11 (Year: 2009).*

Ugbenyen "An Approach to Stimulation Candidate Selection and Optimization", Nov. 2010 (Year: 2010).*

Sylvester et al "Justification for Oil Well Stimulation", May 2015, International Journal of Engineering and Sciences, vol. 4 Issue 5, 73-82 (Year: 2015).*

Rabbani et al "An experimental study of acidizing operation performances on the wellbore productivity index enhancement", Feb. 17, 2018, Journal of Petroleum Exploration and Production Technology, 1243-1253 (Year: 2018).*

Farokhi et al "A comprehensive investigation of the pseudo-skin factor for partially completed vertical wells", Oct. 5, 2012, Journal of Geophysics and Engineering, 642-654 (Year: 2012).*

International Search Report and Written Opinion for International Application No. PCT/US2021/031151 (SA51453), report dated Aug. 30, 2021; pp. 1-15.

PetroWiki; "Formation damage" available as of Feb. 20, 2020 at: https://petrowiki.org/Formation_damage; pp. 1-7.

PetroWiki; "Well stimulation" available as of May 18, 2020 at: https://petrowiki.org/Well_stimulation; pp. 1-4.

PT production-technology.org/introduction-ipr-vlp/; "Introduction to IPR and VLP" May 11, 2017; pp. 1-3.

* cited by examiner

130a

| WELL # A Production Data | | | | | |
|---|---|---|---|---|---|
| | Observed | | | | Estimated |
| FWHP (psi) | 840 | 800 | 770 | 750 | 750 |
| Flowrate (MBOD) | 1231 | 1180 | 1100 | 1050 | 2772 |
| SBHP (psi) | 3400 | 3400 | 3400 | 3400 | 3400 |
| FBHP (psi) | 3000 | 2938 | 2889 | 2856 | 2981 |
| Skin | 12 | 15 | 20 | 24 | 0 |
| Test Date | 2016 | 2017 | 2018 | 2019 | 2020 |

FIG. 3A

130b

| WELL # B Production Data | | | | | |
|---|---|---|---|---|---|
| | Observed | | | | Estimated |
| FWHP (psi) | 740 | 700 | 670 | 650 | 740 |
| Flowrate (MBOD) | 3000 | 2650 | 2500 | 2300 | 4450 |
| SBHP (psi) | 3600 | 3600 | 3600 | 3600 | 3600 |
| FBHP (psi) | 3027 | 2911 | 2840 | 2767 | 3268 |
| Skin | 18 | 29 | 36 | 46 | 0 |
| Test Date | 2016 | 2017 | 2018 | 2019 | 2020 |

FIG. 3B

130c

| WELL # C Production Data | | | | | |
|---|---|---|---|---|---|
| | Observed | | | | Estimated |
| FWHP (psi) | 700 | 700 | 600 | 500 | 700 |
| Flowrate (MBOD) | 2700 | 1726 | 2000 | 2162 | 3900 |
| SBHP (psi) | 3500 | 3500 | 3500 | 3500 | 3500 |
| FBHP (psi) | 3062 | 2986 | 2851 | 2698 | 3221 |
| Skin | 10 | 25 | 28 | 33 | 0 |
| Test Date | 2016 | 2017 | 2018 | 2019 | 2020 |

FIG. 3C

| | Initial Rate ($q_o$) (MBOD) | Estimated Rate ($q_p$) (MBOD) | Oil Gain ($\Delta q$) (MBOD) | Interval Length (m) | Remediation Operation Cost ($C_r$) | Marginal Production Cost ($C_m$) |
|---|---|---|---|---|---|---|
| **Well A** | 1.05 | - | - | - | - | - |
| **Well B** | 2.30 | 4.45 | 1.15 | 3500 | $441,667 | $384/BOD gained |
| **Well C** | 2.16 | 3.90 | 1.74 | 2800 | $383,333 | $220/BOD gained |

FIG. 5

HYDROCARBON WELL STIMULATION BASED ON SKIN PROFILES

FIELD

Embodiments relate generally to developing hydrocarbon wells, and more particularly to operating hydrocarbon wells based on skin profiles.

BACKGROUND

A well typically includes a wellbore (or a "borehole") that is drilled into the earth to provide access to a geologic formation that resides below the earth's surface (or a "subsurface formation"). A well may facilitate the extraction of natural resources, such as hydrocarbons and water, from a subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves a drilling stage, a completion stage and a production stage. The drilling stage involves drilling a wellbore into a portion of the formation that is expected to contain hydrocarbons (often referred to as a "hydrocarbon reservoir" or a "reservoir"). The drilling process is often facilitated by a drilling rig that facilitates a variety of drilling operations, such as operating a drill bit to cut the wellbore. The completion stage involves operations for making the well ready to produce hydrocarbons, such as installing casing, installing production tubing, installing valves for regulating production flow, or pumping substances into the well to fracture, clean or otherwise prepare the well and reservoir to produce hydrocarbons. The production stage involves producing hydrocarbons from the reservoir by way of the well. During the production stage, the drilling rig is typically replaced with a production tree that includes valves that are operated to, for example, regulate production flow rate and pressure. The production tree typically includes an outlet that is connected to a distribution network of midstream facilities, such as tanks, pipelines or transport vehicles that transport production from the well to downstream facilities, such as refineries or export terminals.

The various stages of developing a hydrocarbon well can include a variety of challenges that are addressed to successfully develop the well. For example, during production operations, a well operator typically engages in operations to optimize the overall production of hydrocarbons from the reservoir. The can include regulating well operating flow rates and pressures based on characteristics of the wellbore, the formation, the production, and operations of nearby wells. In some instances, the operations involve stimulation operations to enhance the flow of hydrocarbons into the wellbore of the well. For example, a well operator may conduct an acid injection to dissolve formation damage that results from elements, such as drilling mud or formation particles, plugging the formation lining the wellbore.

SUMMARY

Understanding the characteristics of a well and associated cost of operation can be critical aspects to effectively and efficiently developing hydrocarbon wells. For example, holding a well's production rate at inappropriate level for an extended period of time can increase a risk of premature well depletion, water breakthrough, or other complications, which can reduce hydrocarbon production from the well and increase marginal costs of production for the well. In addition to these general considerations, a well operator may consider other factors that can influence the effective and efficient development of a well, such as physical damage to the formation. For example, formation rock surrounding the wellbore of a well may be invaded by drilling fluids or other debris that can create a zone of reduced formation permeability in the vicinity of the wellbore. This influence on the permeability is often referred to as "skin damage" (or "skin"). The skin for a wellbore extending into a formation may include a dimensionless measure of pressure drop caused by flow restriction in the near-wellbore region of the formation. In some instances, the impact of skin on productivity of a well can be characterized by inflow performance relationships (IPRs) that illustrate bottom hole pressure (BHP) of the well as a function of production flow rate (q) of the well. Unfortunately, the skin of a well can increase over the life of the well, which can negatively impact production performance of the well. In some instances, remediation operations, such as stimulations, are conducted on a well to reduce the well's skin in an effort to improve the well's production performance. For example, in an effort to enhance the flow of hydrocarbons into the wellbore of the well, a well operator may conduct an acid injection type stimulation to dissolve elements, such as drilling mud or formation particles, that are plugging pores of the formation lining the wellbore. Unfortunately, remediation operations can be expensive and time consuming.

Provided are systems and method for developing hydrocarbon wells based on historical skin profiles of the wells. In some embodiments, hydrocarbon wells that are candidates for remediation operations are selected based historical skin profiles for the wells. This may include, for example, the following operations: (1) identifying a skin increase threshold that is indicative of an acceptable amount increase in the skin of a well; (2) for each of two or more hydrocarbon wells: (a) collecting historical production data that is indicative of observed production characteristics for the well over a given period of time (e.g., flow rate, FWHP, FBHP, SBHP, or skin for the well at different points in time across the given period of time); (b) determining, based on the historical production data, a skin profile that is indicative of a change in the skin of the well over the given period of time (e.g., a skin profile that is indicative of a rate of change of the skin for the well over the given period of time); (c) determining whether the change in the skin of the well over the given period of time exceeds the skin increase threshold; and (d) in response to determining that change in the skin of the well over the given period of time exceeds the skin increase threshold, identifying the well as a candidate for a well remediation operation (e.g., a candidate for an acid injection type stimulation operation); (2) for each of the wells identified as a candidate for remediation: (a) determining an observed production flow rate ($q_o$) for the well; (b) determining a predicted (or "fully remediated") production flow rate ($q_p$) of the well that corresponds to the well having a skin of zero; (c) determining remediation parameters for a remediation of the well (e.g., determine parameters for an acid injection type stimulation operation to remediate the wellbore of the well); (d) determining, based on the remediation parameters, a cost of the remediation operation ($C_r$) for the well (e.g., determine a total operation cost based on the amount of materials, time, and labor required to conduct an acid injection type stimulation of a damaged interval of the wellbore 120 of the well 106); (e)

determining, based on the observed production flow rate ($q_o$) and the predicted production flow rate ($q_p$), a predicted increase in production flow rate ($\Delta q$) for the well that would be attributable to the remediation of the well (e.g., determining an expected increase in production flow rate ($\Delta q = q_p - q_o$) that is attributable to the acid injection type stimulation of the damaged interval of the wellbore of the well); (f) determining, based on the cost of the remediation operation ($C_r$) for the well and the predicted increase in production flow rate ($\Delta q$) that is attributable to the remediation operation, a marginal production cost ($C_m$) for increased production attributable to the remediation operation (e.g., determining a marginal production cost ($C_m = C_r / \Delta q$) for an increase in production attributable to the acid injection type stimulation of the damaged interval of the wellbore of the well); and (3) selecting, from the wells identified as candidates for remediation and based on the marginal production costs ($C_m$) for the wells, one or more wells to be remediated (e.g., selecting, from the wells identified as candidate wells for remediation, one or more wells having a relatively low marginal production cost ($C_m$)). In some embodiments, a remediation operation is scheduled and conducted for the selected well(s). For example, an operator of the well(s) may control the well system(s) to conduct an acid injection for the damaged interval(s) of the wellbore(s) 120 of the well(s) 106 selected.

Provided in some embodiments is a method of developing a hydrocarbon well. The method includes the following: determining a skin increase threshold for a given period of time; for each of two or more hydrocarbon wells: collecting historical production data that is indicative of observed production characteristics for the hydrocarbon well over the given period of time; determining, based on the historical production data, a skin profile that is indicative of a change in a skin of the hydrocarbon well over the given period of time; determine whether the change in the skin of the hydrocarbon well over the given period of time exceeds the skin increase threshold; and identifying, in response to determining that change in the skin of the hydrocarbon well over the given period of time exceeds the skin increase threshold, the hydrocarbon well as a candidate well for stimulation; for each of the hydrocarbon wells identified as a candidate well for stimulation: determining an observed production flow rate for the hydrocarbon well; determining a predicted production flow rate of the hydrocarbon well that corresponds to the hydrocarbon well having a skin of zero; determining stimulation parameters that define parameters for a stimulation operation to remediate the wellbore of the hydrocarbon well; determining, based on the stimulation parameters, a cost of the stimulation operation for the hydrocarbon well; determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation; selecting, based on the marginal production costs for the hydrocarbon wells and from the hydrocarbon wells identified as candidate wells for stimulation, a hydrocarbon well to be stimulated; and conducting a stimulation of the hydrocarbon well selected.

In some embodiments, the stimulation of the hydrocarbon well includes an acid injection type stimulation of the hydrocarbon well. In certain embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero. In some embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero and operating at a last observed static borehole pressure. In certain embodiments, the skin increase threshold includes a rate of change of skin over the given period of time, and the change in a skin of the hydrocarbon well over the given period of time includes a rate of change of the skin of the hydrocarbon well over the given period of time. In some embodiments, the stimulation parameters include a length of an interval of the wellbore of the hydrocarbon well to be treated, and the cost of the stimulation operation for the hydrocarbon well is determined based on the length of the interval of the wellbore of the hydrocarbon well to be treated. In certain embodiments, the method further includes generating an ordered ranking of the hydrocarbon wells identified as candidate wells for stimulation, and the hydrocarbon well to be stimulated is selected based on the ordered ranking of the hydrocarbon wells identified as candidate wells for stimulation.

Provided in some embodiments is a hydrocarbon well system that includes the following: a well production system adapted to operate the hydrocarbon well; and a well control system adapted to perform the following operations: determining a skin increase threshold for a given period of time; for each of two or more hydrocarbon wells: collecting historical production data that is indicative of observed production characteristics for the hydrocarbon well over the given period of time; determining, based on the historical production data, a skin profile that is indicative of a change in a skin of the hydrocarbon well over the given period of time; determining whether the change in the skin of the hydrocarbon well over the given period of time exceeds the skin increase threshold; and identifying, in response to determining that change in the skin of the hydrocarbon well over the given period of time exceeds the skin increase threshold, the hydrocarbon well as a candidate well for stimulation; for each of the hydrocarbon wells identified as a candidate well for stimulation: determining an observed production flow rate for the hydrocarbon well; determining a predicted production flow rate of the hydrocarbon well that corresponds to the hydrocarbon well having a skin of zero; determining stimulation parameters that define parameters for a stimulation operation to remediate the wellbore of the hydrocarbon well; determining, based on the stimulation parameters, a cost of the stimulation operation for the hydrocarbon well; determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation; selecting, based on the marginal production costs for the hydrocarbon wells and from the hydrocarbon wells identified as candidate wells for stimulation, a hydrocarbon well to be stimulated; and controlling the well production system to conduct a stimulation of the hydrocarbon well selected.

In some embodiments, the stimulation of the hydrocarbon well includes an acid injection type stimulation of the hydrocarbon well. In certain embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero. In some embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero and operating at a last observed static borehole pressure. In certain embodiments, the skin increase threshold includes a rate of change of skin over the given period of time, and the change in a skin of the hydrocarbon well over the given period of time includes a rate of change of the skin of the hydrocarbon well over the given period of time. In some embodiments, the stimulation parameters include a length of an interval of the wellbore of the hydrocarbon well to be treated, and the cost of the stimulation operation for the hydrocarbon well is determined based on the length of the interval of the wellbore of the hydrocarbon well to be treated. In certain embodiments, the operations further including generating an ordered ranking of the hydrocarbon wells identified as candidate wells for stimulation, and the hydrocarbon well to be stimulated is selected based on the ordered ranking of the hydrocarbon wells identified as candidate wells for stimulation.

Provided in some embodiments is a non-transitory computer readable storage medium including program instructions stored thereon that are executable by a processor to perform the following operations for developing a hydrocarbon well: determining a skin increase threshold for a given period of time; for each of two or more hydrocarbon wells: collecting historical production data that is indicative of observed production characteristics for the hydrocarbon well over the given period of time; determining, based on the historical production data, a skin profile that is indicative of a change in a skin of the hydrocarbon well over the given period of time; determining whether the change in the skin of the hydrocarbon well over the given period of time exceeds the skin increase threshold; and identifying, in response to determining that change in the skin of the hydrocarbon well over the given period of time exceeds the skin increase threshold, the hydrocarbon well as a candidate well for stimulation; for each of the hydrocarbon wells identified as a candidate well for stimulation: determining an observed production flow rate for the hydrocarbon well; determining a predicted production flow rate of the hydrocarbon well that corresponds to the hydrocarbon well having a skin of zero; determining stimulation parameters that define parameters for a stimulation operation to remediate the wellbore of the hydrocarbon well; determining, based on the stimulation parameters, a cost of the stimulation operation for the hydrocarbon well; determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation; selecting, based on the marginal production costs for the hydrocarbon wells and from the hydrocarbon wells identified as candidate wells for stimulation, a hydrocarbon well to be stimulated; and controlling a well production system to conduct a stimulation of the hydrocarbon well selected.

In some embodiments, the stimulation of the hydrocarbon well includes an acid injection type stimulation of the hydrocarbon well. In certain embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero. In some embodiments, determining a predicted production flow rate of the hydrocarbon well that corresponds to the hydrocarbon well having a skin of zero includes conducting a simulation of the hydrocarbon well based on a modeling of the hydrocarbon well with a skin of zero and operating at a last observed static borehole pressure. In certain embodiments, the skin increase threshold includes a rate of change of skin over the given period of time, and the change in a skin of the hydrocarbon well over the given period of time includes a rate of change of the skin of the hydrocarbon well over the given period of time. In some embodiments, the stimulation parameters include a length of an interval of the wellbore of the hydrocarbon well to be treated, and the cost of the stimulation operation for the hydrocarbon well is determined based on the length of the interval of the wellbore of the hydrocarbon well to be treated. In certain embodiments, the operations further include generating an ordered ranking of the hydrocarbon wells identified as candidate wells for stimulation, and the hydrocarbon well to be stimulated is selected based on the ordered ranking of the hydrocarbon wells identified as candidate wells for stimulation.

BRIEF DESCRIPTION OF THE DRAWINGS

FIGS. 3A-3C are diagrams that illustrate example well production data in accordance with one or more embodiments.

FIG. 5 is a diagram that illustrates example estimated production parameters in accordance with one or more embodiments.

Figure 1:
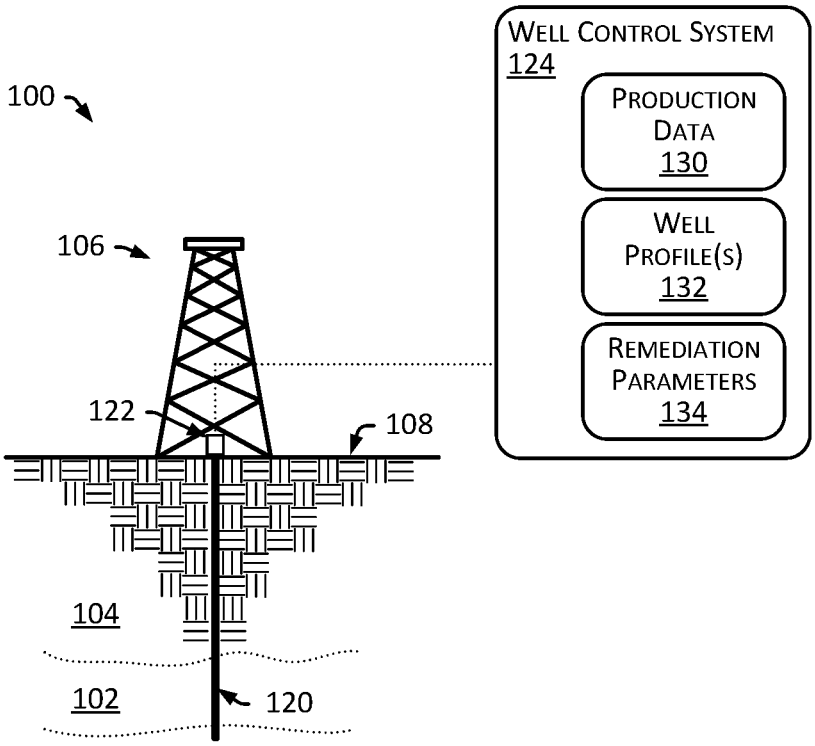
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and method for developing hydrocarbon wells based on historical skin profiles of the wells. In some embodiments, hydrocarbon wells that are candidates for remediation operations are selected based historical skin profiles for the wells. This may include, for example, the following operations: (1) identifying a skin increase threshold that is indicative of an acceptable amount increase in the skin of a well; (2) for each of two or more hydrocarbon wells: (a) collecting historical production data that is indicative of observed production characteristics for the well over a given period of time (e.g., flow rate, FWHP, FBHP, SBHP, or skin for the well at different points in time across the given period of time); (b) determining, based on the historical production data, a skin profile that is indicative of a change in the skin of the well over the given period of time (e.g., a skin profile that is indicative of a rate of change of the skin for the well over the given period of time); (c) determining whether the change in the skin of the well over the given period of time exceeds the skin increase threshold; and (d) in response to determining that change in the skin of the well over the given period of time exceeds the skin increase threshold, identifying the well as a candidate for a well remediation operation (e.g., a candidate for an acid injection type stimulation operation); (2) for each of the wells identified as a candidate for remediation: (a) determining an observed production flow rate ($q_o$) for the well; (b) determining a predicted (or "fully remediated") production flow rate ($q_p$) of the well that corresponds to the well having a skin of zero; (c) determining remediation parameters for a remediation of the well (e.g., determine parameters for an acid injection type stimulation operation to remediate the wellbore of the well); (d) determining, based on the remediation parameters, a cost of the remediation operation ($C_r$) for the well (e.g., determine a total operation cost based on the amount of materials, time, and labor required to conduct an acid injection type stimulation of a damaged interval of the wellbore 120 of the well 106); (e) determining, based on the observed production flow rate ($q_o$) and the predicted production flow rate ($q_p$), a predicted increase in production flow rate ($\Delta q$) for the well that would be attributable to the remediation of the well (e.g., determining an expected increase in production flow rate ($\Delta q = q_p - q_o$) that is attributable to the acid injection type stimulation of the damaged interval of the wellbore of the well); (f) determining, based on the cost of the remediation operation ($C_r$) for the well and the predicted increase in production flow rate ($\Delta q$) that is attributable to the remediation operation, a marginal production cost ($C_m$) for increased production attributable to the remediation operation (e.g., determining a marginal production cost ($C_m = C_r / \Delta q$) for an increase in production attributable to the acid injection type stimulation of the damaged interval of the wellbore of the well); and (3) selecting, from the wells identified as candidates for remediation and based on the marginal production costs ($C_m$) for the wells, one or more wells to be remediated (e.g., selecting, from the wells identified as candidate wells for remediation, one or more wells having a relatively low marginal production cost ($C_m$)). In some embodiments, a remediation operation is scheduled and conducted for the selected well(s). For example, an operator of the well(s) may control the well system(s) to conduct an acid injection for the damaged interval(s) of the wellbore(s) 120 of the well(s) 106 selected.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104 and a well system ("well") 106.

The formation 104 may include a porous or fractured rock formation that resides beneath the earth's surface (or "surface") 108. The reservoir 102 may be a hydrocarbon reservoir defined by a portion of the formation 104 that contains (or that is at least determined or expected to contain) a subsurface pool of hydrocarbons, such as oil and gas. The formation 104 and the reservoir 102 may each include layers of rock having varying characteristics, such as varying degrees of permeability, porosity, and fluid saturation. In the case of the well 106 being operated as a production well, the well 106 may be a hydrocarbon production well that is operable to facilitate the extraction of hydrocarbons (or "production") from the reservoir 102.

The well 106 may include a wellbore 120, a production system 122, and a well control system ("control system") 124. The wellbore 120 may be, for example, a bored hole that extends from the surface 108 into a target zone of the formation 104, such as the reservoir 102. The wellbore 120 may be created, for example, by a drill bit of a drilling system of the well 106 boring through the formation 104 and the reservoir 102. An upper end of the wellbore 120 (e.g., located at or near the surface 108) may be referred to as the "up-hole" end of the wellbore 120. A lower end of the wellbore 120 (e.g., terminating in the formation 104) may be referred to as the "down-hole" end of the wellbore 120.

In some embodiments, the production system 122 includes production devices that facilitate that extraction of production from the reservoir 102 by way of the wellbore 120. For example, the production system 122 may include valves, pumps and sensors that are operable to regulate the flow of production from the wellbore 120 and to monitor production parameters (e.g., production flow rate, temperature, and pressure). The sensors may include, for example, a flow rate sensor that is operable to sense a rate of the flow of production from the wellbore 120 (e.g., to sense the production flow rate (q) of the well 106), a pressure sensor that is operable to sense pressure at an up-hole end of the wellbore 120 (e.g., a wellhead pressure sensor that is operable to sense a wellhead pressure (WHP) of the well 106), a down-hole pressure sensor that is operable to sense pressure in a lower (or "down-hole") portion of the wellbore 120 (e.g., a bottom hole pressure (BHP) sensor that is operable to sense a bottom hole pressure (BHP) of the well 106), or a water cut sensor that is operable to sense water content of production flowing from the wellbore 120. A BHP or WHP sensed while production is flowing in the wellbore 120 (e.g., $q>0$) may be referred to as flowing BHP (or "FBHP") or flowing WHP (or "FWHP"), respectively. A BHP or WHP sensed while production is not flowing in the wellbore 120 may be referred to a static BHP (or "SBHP") or static WHP (or "SWHP"), respectively.

In some embodiments, the well control system 124 is operable to control various operations of the well 106, such as well drilling operations, well completion operations, well production operations, or well or formation remediation operations. For example, the well control system 124 may include a well system memory and a well system processor that are capable of performing the various processing and control operations of the well control system 124 described. In some embodiments, the well control system 124 includes a computer system that is the same as or similar to that of computer system 1000 described with regard to at least FIG. 6.

In some embodiments, the well control system 124 is operable to identify a well 106 that is a candidate for remediation based on a historical skin profile for the well. This may include, for example, the well control system 124 performing the following operations: (1) identifying a skin increase threshold that is indicative of an acceptable amount increase in the skin of a well; (2) for each of two or more hydrocarbon wells: (a) collecting historical production data (or "production data") 130 that is indicative of observed production characteristics for the well 106 over a given period of time (e.g., flow rate, FWHP, FBHP, SBHP, or skin for the well 106 at different points in time across the given period of time); (b) determining, based on the historical production data, well profiles 132 that include a skin profile that is indicative of a change in the skin of the well 106 over the given period of time (e.g., a skin profile that is indicative of a rate of change of the skin for the well 106 over the given period of time); (c) determining whether the change in the skin of the well 106 over the given period of time exceeds the skin increase threshold; and (d) in response to determining that change in the skin of the well 106 over the given period of time exceeds the skin increase threshold, identifying the well 106 as a candidate for a well remediation operation (e.g., a candidate for an acid injection type stimulation operation); (2) for each of the wells 106 identified as a candidate for a well remediation operation: (a) determining an observed production flow rate ($q_o$) for the well 106; (b) determining a predicted (or "fully remediated") production flow rate ($q_p$) of the well 106 that corresponds to the well 106 having a skin of zero; (c) determining remediation parameters 134 for a remediation of the well 106 (e.g., determine parameters for an acid injection type stimulation operation to remediate the wellbore 120 of the well 106); (d) determining, based on the remediation parameters 134, a cost of the remediation operation ($C_r$) for the well 106 (e.g., determining a total operation cost based on the amount of materials, time, and labor required to conduct an acid injection type stimulation of a damaged interval of the wellbore 120 of the well 106); (e) determining, based on the observed production flow rate ($q_o$) and the predicted production flow rate ($q_p$), a predicted increase in production flow rate ($\Delta q$) for the well 106 that would be attributable to the remediation of the well 106 (e.g., determine an expected increase in production flow rate ($\Delta q = q_p - q_o$) that is attributable to the acid injection type stimulation of the damaged interval of the wellbore 120 of the well 106); (f) determining, based on the cost of the remediation operation ($C_r$) for the well 106 and the predicted increase in production flow rate ($\Delta q$) that is attributable to the remediation operation, a marginal production cost ($C_m$) for increased production attributable to the remediation operation (e.g., determine a marginal production cost ($C_m = C_r/\Delta q$) for an increase in production attributable to the acid injection type stimulation of the damaged interval of the wellbore 120 of the well 106); and (3) selecting, from the wells 106 identified as candidates for remediation and based on the marginal production costs ($C_m$) for the wells 106, one or more wells 106 to be remediated (e.g., selecting, from the wells 106 identified as candidate wells for remediation, one or more wells 106 having the lowest marginal production cost ($C_m$)). In some embodiments, a remediation operation is scheduled and conducted for the selected well(s) 106. For example, the well control system 124 (or another operator of the well(s) 106) may control devices of the well(s) 106 to conduct an acid injection for the damaged interval(s) of the wellbore(s) 120 of the well(s) 106 selected.

Figure 2:
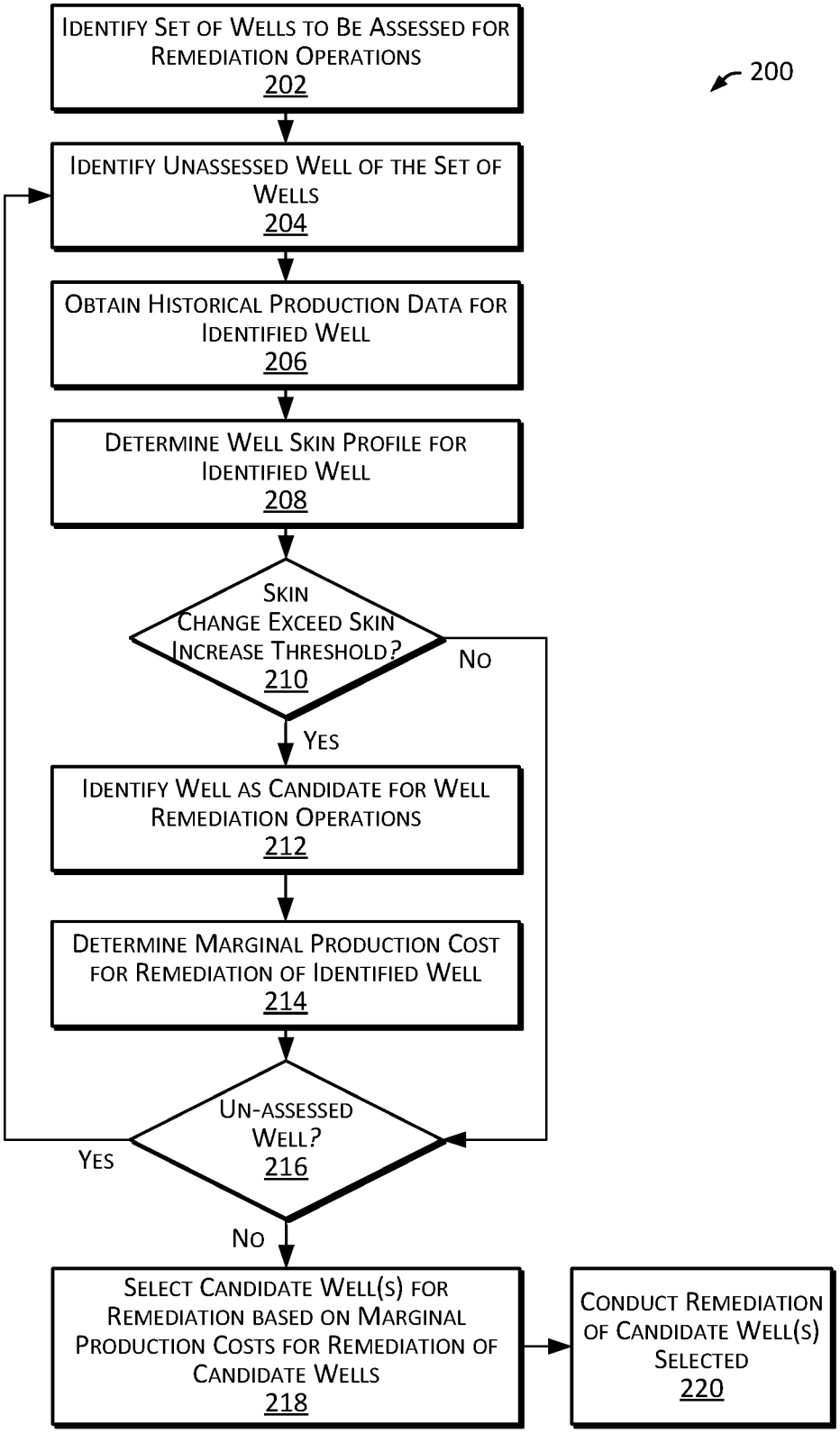
FIG. 2 is a flowchart that illustrates a method of operating a well in accordance with one or more embodiments.

FIG. 2 is a flowchart that illustrates a method 200 of conducting a remediation of a hydrocarbon well in accordance with one or more embodiments. In the context of the well 106, some or all of the operations of method 200 may be performed by the well control system 124 (or another operator of the well 106).

In some embodiments, method 200 includes identifying a set of wells to be assessed for remediation operations (block 202). This may include determining a group of wells that are potential candidates for a remediation operation. For example, identifying a set of wells to be assessed for remediation operations may include the well control system 124 determining a set of ten wells 106 in the reservoir 102 that are being operated by a given well operating company.

In some embodiments, method 200 includes identifying an unassessed well of the set of wells to be assessed for remediation operations (block 204). This may include identifying a well of the group of wells that are potential candidates for a remediation operation, and that has not yet been assessed to determine whether the well is to be designated as a candidate for remediation operations. Continuing with the prior example, this may include the well control system 124 identifying a first well (e.g., Well A) 106 from the set of ten wells 106 in a first iteration, identifying a second well (e.g., Well B) 106 from the nine unassessed wells 106 in a second iteration, identifying a third well (e.g., Well C) 106 from the eight unassessed wells 106 in a third iteration, and so forth.

In some embodiments, method 200 includes obtaining historical production data for the currently identified well (block 206). This may include obtaining historical production data that is indicative of observed characteristics for the currently identified well over a given period of time. The historical production data may include, for example, measured values of flow rate (e.g., in thousands of barrels of oil per day (MBOD)), FWHP (e.g., in pounds per square inch (psi)), FBHP (e.g., in psi), and SBHP (e.g., in psi), and a determined skin (e.g., dimensionless) for the well 106 at different points in time across a given period of time. Continuing with the prior example, this may include the well control system 124 obtaining a first set of production data 130*a* for the first well (e.g., Well A) 106 in the first iteration, obtaining a second set of production data 130*b* for the second well (e.g., Well B) 106 in the second iteration, obtaining a third set of production data 130*c* for the third well (e.g., Well C) 106 in the third iteration, and so forth.

FIGS. 3A-3C are diagrams that illustrate example well production data 130 in accordance with one or more embodiments. FIG. 3A illustrates a first set of "observed" well production data 130*a* that is based on observed production characteristics of the first well 106 across the time period of 2016 to 2019. FIG. 3B illustrates a second set of "observed" well production data 130*b* that is based on observed production characteristics of the second well 106 across the time period of 2016 to 2019. FIG. 3C illustrates a third set of "observed" well production data 130*c* that is based on observed production characteristics of the third well 106 across the time period of 2016 to 2019. The observed production data 130 for each of the well 106 may be determined, for example, based on measurements acquired during annual testing of the respective well 106 or during normal operation of the well 106 across the corresponding year. As described, the "estimated" production data 130 for each of the wells 106 may be determined based on a modeling of the respective well 106 with an assumed skin of zero.

In some embodiments, method 200 includes determining a well skin profile for the currently identified well (block 208). This may include determining a well profile for the identified well that includes an indication of changes in the skin of the well across the given period of time. Continuing with the prior example, this may include the well control system 124 determining a first well profile 132*a* for the first well (e.g., Well A) 106 in the first iteration, determining a second well profile 132*b* for the second well (e.g., Well B) 106 in the second iteration, determining a third well profile 132*c* for the third well (e.g., Well C) 106 in the third iteration, and so forth.

Figure 4A:
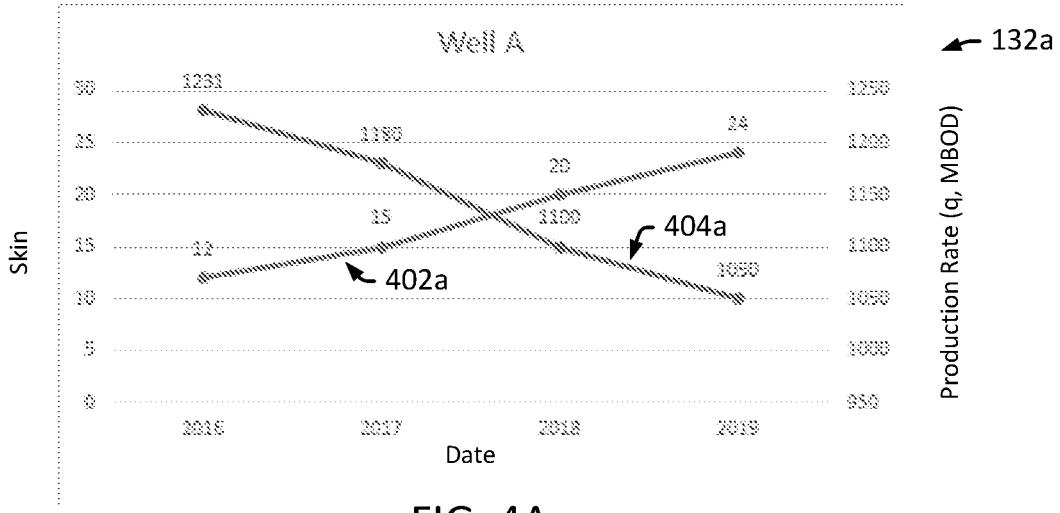
FIGS. 4A-4C are diagrams that illustrate example well profiles in accordance with one or more embodiments.
Figure 4B:
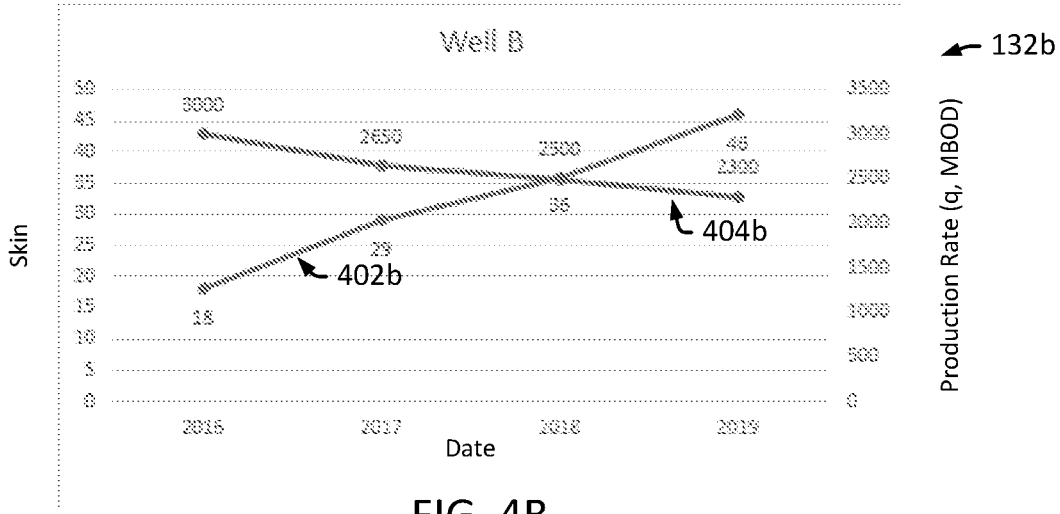
Figure 4C:
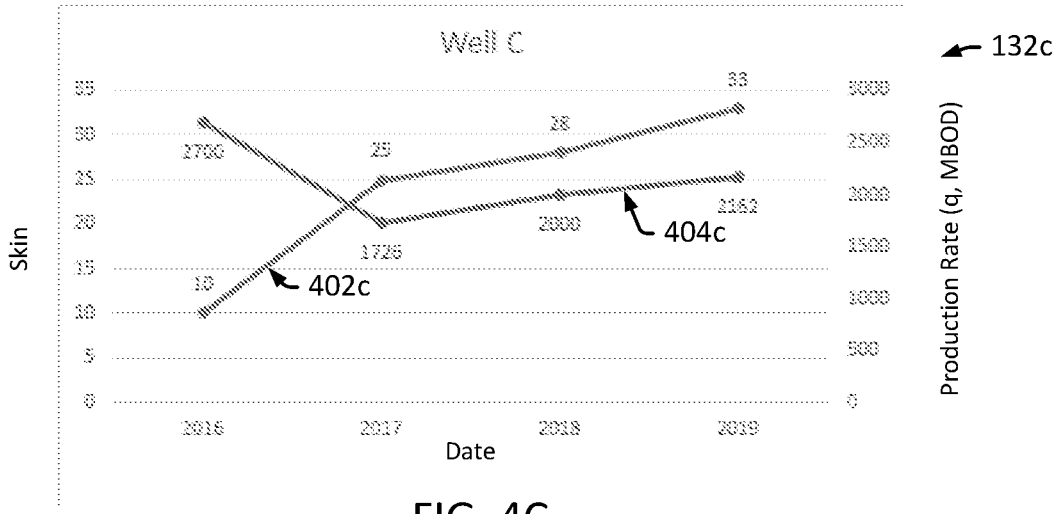

FIGS. 4A-4C are diagrams that illustrate example well profiles in accordance with one or more embodiments. FIG. 4A illustrates a first well profile 132*a* that includes a first skin profile 402*a* and a first production rate profile 404*a* for the first well 106. FIG. 4B illustrates a second well profile 132*b* that includes a second skin profile 402*b* and a second production rate profile 404*b* for the second well 106. FIG. 4C illustrates a third well profile 132*c* that includes a third skin profile 402*c* and a third production rate profile 404*c* for the third well 106. Each of the skin profiles 402*a* includes a plot of the skin values for the time period of 2016 to 2019 (e.g., based on the corresponding production data 130*a*, 130*b* and 130*c* of FIGS. 3A, 3B and 3C). Each of the production rate profile 404*a*, 404*b* and 404*c* includes a plot of the flow rate values for the time period of 2016 to 2019 (e.g., based on the corresponding production data 130*a*, 130*b* and 130*c* of FIGS. 3A, 3B and 3C).

In some embodiments, method 200 includes determining whether a skin for the currently identified well exceeds a skin increase threshold (block 210). This may include determining a skin increase threshold, determining (based on the well profile for the well) a change in the skin of the well across the given period of time, and determining whether the change in the skin of the well exceeds the skin increase threshold. In some embodiments, the change in the skin of a well 106 (or "skin change") is defined as a rate of change of the skin across the given period of time, or a sub interval thereof. For example, skin changes of 3.00/year (e.g., +12/4 years), 7.00/year (e.g., +28/4 years) and 5.75/year (e.g., +23/4 years) may be determined for the first, second and third wells 106, respectively, for the four year time period of 2016 to 2019 (e.g., based on the corresponding observed production data 130*a*, 130*b* and 130*c* of FIGS. 3A, 3B and 3C). In some embodiments, the skin change of a well 106 is defined as net change of the skin across the given period of time, or a sub interval thereof. For example, skin changes of 12 (e.g., 24-12), 28 (e.g., 46-18) and 23 (e.g., 33-10) may be determined for the first, second and third wells 106, respectively, for the four year time period of 2016 to 2019 (e.g., based on the corresponding observed production data 130*a*, 130*b* and 130*c* of FIGS. 3A, 3B and 3C).

Continuing with the prior example, this may include the well control system 124 determining a skin increase threshold of 5.00/year, and determining, in the first iteration, that the first well 106 has a first skin change of 3.00/year which does not exceed the skin increase threshold, determining, in the second iteration, that the second well 106 has a second skin change of 7.00/year which exceeds the skin increase threshold, and determining, in the third iteration, that the third well 106 has a third skin change of 5.75/year which exceeds the skin increase threshold, and so forth.

In some embodiments, method 200 includes, in response to determining that a change in the skin of a well exceeds the skin increase threshold, identifying the currently identified well as a candidate for well remediation operations (block 212). Continuing with the prior example, this may include the well control system 124 identifying the second and third wells 106 as candidates for well remediation operations, such as acid injection type stimulation operations, and excluding the first well 106 as a candidate for well remediation operations.

In some embodiments, method 200 includes determining a marginal production cost for remediation of the currently identified well (block 214). This may include determining a cost of a remediation operation ($C_r$) for the well, determining a predicted increase in production flow rate ($\Delta q$) for the well that would be attributable to the remediation of the well, and determining, based on the cost of the remediation operation ($C_r$) and the predicted increase in production flow rate ($\Delta q$), a marginal production cost ($C_m$) for increased production attributable to the remediation operation.

In some embodiments, a cost of a remediation operation ($C_r$) for a well is a total operation cost based on the amount of materials, time, and labor required to conduct the remediation of the well in accordance with remediation parameters 134. In the case of an acid injection type stimulation of a well, this may include costs for the acid and other substances and materials used to treat the well, costs associated with the lack of production during the stimulation operation, costs of equipment needed to conduct the remediation operation, and the costs of personnel that are needed to carry out the stimulation operation. In some embodiments, the cost of the remediation operation ($C_r$) is determined based on an interval length of a wellbore to be treated. For example, the cost of the remediation operation ($C_r$) may be determined as a fixed amount to conduct the operation (e.g., $100,000/stimulation) plus an additional amount per meter (m) (e.g., $1000/m) of the wellbore to be treated. Continuing with the prior example, this may include the well control system 124 determining costs of $416,667 and $383,333 for acid injection stimulation type remediation of the second and third wells 106, respectively (see, e.g., FIG. 5).

In some embodiments, a predicted increase in production flow rate (or "oil gain") ($\Delta q$) for a well that would be attributable to a remediation of the well is determined based on a predicted (or "fully remediated") production flow rate ($q_p$) of the well that corresponds to the well having a skin of zero. For example, a simulation of a well may be generated based on a modeling of the well that assumes a skin of zero (e.g., assumes elimination of the skin of the well) and at the most recent flow rate (q) of the corresponding production data 130, to determine a predicted production flow rate ($q_p$) that corresponds to a remediation operation that eliminates the skin of the well. The predicted increase in production flow rate ($\Delta q$) may be determined as the difference between the most recently observed flow rate ($q_o$) of the production data for the well and the predicted production flow rate ($q_p$) (e.g., $\Delta q = q_p - q_o$) for the well. Continuing with the prior example, this may include the well control system 124 determining predicted increases in production flow rates (or "oil gains") ($\Delta q$) of 1.15 MBOD (e.g., 1.15 MBOD=4.45 MBOD−2.30 MBOD) and 1.74 MBOD (e.g., 1.74 MBOD=3.90 MBOD−2.16 MBOD) for the second and third wells 106, respectively (see, e.g., FIGS. 3A-3C and FIG. 5).

In some embodiments, a marginal production cost ($C_m$) for increased production of a well that is attributable to a remediation operation for the well is defined as the cost of the associated remediation operation ($C_r$) divided by the associated predicted increase in production flow rate (or "oil gain") ($\Delta q$) (e.g., $C_m = C_r/\Delta q$). Continuing with the prior example, this may include the well control system 124 determining marginal production costs ($C_m$) of about $384/BOD gained and $220/BOD gained for the second and third wells 106, respectively (see, e.g., FIG. 5).

In some embodiments, method 200 includes, in response to determining that at least one well of the group of wells that are potential candidates for a remediation operation has not yet been assessed to determine whether the well is to be designated as a candidate for remediation operations (block 216), conducting a next iteration of assessment of an unassessed well of the group of wells. For example, after a first iteration that includes an assessment of the first well (Well A) 106, the well control system 124 may proceed to a second iteration that includes an assessment of the second well (Well B) 106. In some embodiments, method 200 includes, in response to identifying that all wells of the group of wells that are potential candidates for a remediation operation have been assessed to determine candidates for remediation operations (block 216), proceeding to select one or more of the candidate wells for remediation based on the marginal production cost ($C_m$). This may include selecting one or more of the wells identified as candidate wells having the lowest marginal production cost ($C_m$). For example, if a well operator has indicated that it plans to remediate a single well, and the third well (Well C) 106 has the lowest marginal production cost ($C_m$) of the wells 106 identified as candidate wells, this may include the well control system 124 selecting Well C as the candidate well 106 for remediation. As a further example, if a well operator has indicated that it plans to remediate two wells, and the second and third wells (Wells B and C) have the two lowest marginal production cost ($C_m$) of the wells 106 identified as candidate wells, this may include the well control system 124 selecting the second and third wells (Wells B and C) 106 as the candidate wells 106 for remediation. In some embodiments, a ranking of the candidate wells, from the lowest marginal production cost ($C_m$) to the highest marginal production cost ($C_m$) is generated. Continuing with the prior example, such a ranking may be provided to and used by a well operator to prioritize well remediation operations among the set of ten wells 106.

In some embodiments, method 200 includes, conducting remediation of a candidate well selected (block 220). This may include proceeding to conduct a remediation operation of some or all of the candidate wells selected for remediation. Continuing with the prior example of a well operator planning to remediate a single well, the third well (Well C) 106 being selected for remediation based on it being associated with the lowest marginal production cost ($C_m$) and the remediation operation being an acid injection stimulation type remediation operation, this may include the well control system 124 (or another operator of the third well (Well C) 106) controlling the third well (Well C) 106 to conduct an acid injection for one or more damaged intervals of the wellbore 120 of the third well (Well C) 106 in accordance with corresponding remediation parameters 134.

Figure 6:
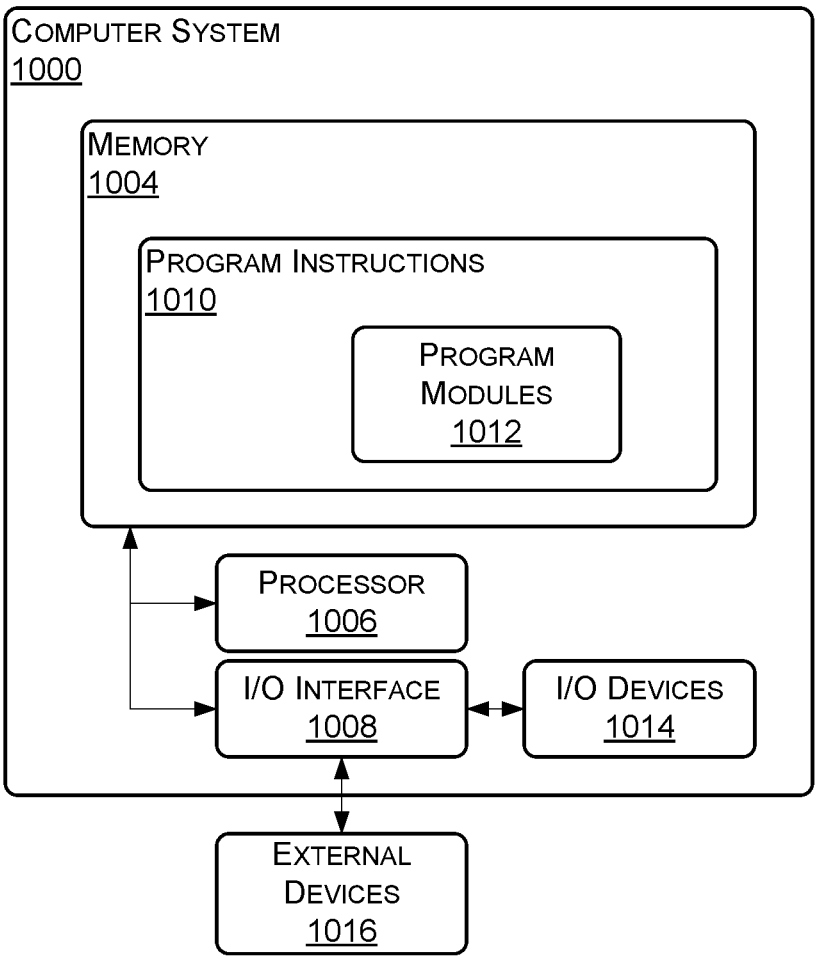
FIG. 6 is a diagram that illustrates an example computer system in accordance with one or more embodiments.

FIG. 6 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (for example, the processor 1006) to cause the functional operations described, such as those described with regard to the well control system 124 (or another operator of the well 106), or the method 200.

The processor 1006 may be any suitable processor capable of executing program instructions. The processor 1006 may include a central processing unit (CPU) that carries out program instructions (for example, the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (for example, an Industrial Ethernet connection) or a wireless connection (for example, a Wi-Fi connection). The I/O interface 1008 may provide an interface for communication with one or more external devices 1016. In some embodiments, the I/O interface 1008 includes one or both of an antenna and a transceiver. The external devices 1016 may include, for example, devices of the production system 122.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on"

data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a hydrocarbon well, the method comprising:

determining a skin increase threshold for a given period of time;

for each of two or more hydrocarbon wells:

collecting historical production data that is indicative of observed production characteristics for the hydrocarbon well over the given period of time;

determining, based on the historical production data, a skin profile that is indicative of a change in a skin of the hydrocarbon well over the given period of time;

determining whether the change in the skin of the hydrocarbon well over the given period of time exceeds the skin increase threshold, wherein the skin increase threshold comprises a rate of change of skin over the given period of time, and the change in a skin of the hydrocarbon well over the given period of time comprises a rate of change of the skin of the hydrocarbon well over the given period of time; and identifying, in response to determining that change in the skin of the hydrocarbon well over the given period of time exceeds the skin increase threshold, the hydrocarbon well as a candidate well for stimulation;

for each of the hydrocarbon wells identified as a candidate well for stimulation:

determining an observed production flow rate for the hydrocarbon well;

determining a predicted production flow rate of the hydrocarbon well that corresponds to the hydrocarbon well having a skin of zero;

determining stimulation parameters that define parameters for a stimulation operation to remediate the wellbore of the hydrocarbon well;

determining, based on the stimulation parameters, a cost of the stimulation operation for the hydrocarbon well;

determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation;

selecting, based on the marginal production costs for the hydrocarbon wells and from the hydrocarbon wells identified as candidate wells for stimulation, a hydrocarbon well to be stimulated; and conducting the stimulation operation of the hydrocarbon well selected, wherein stimulation of the selected hydrocarbon well increases production to the predicted increase in production flow rate.

2. The method of claim 1, wherein the simulation operation of the hydrocarbon well comprises an acid injection type stimulation of the hydrocarbon well.

3. The method of claim 1, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero.

4. The method of claim 1, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero and operating at a last observed static borehole pressure.

5. The method of claim 1, wherein the stimulation parameters comprise a length of an interval of the wellbore of the hydrocarbon well to be treated, and wherein the cost of the stimulation operation for the hydrocarbon well is determined based on the length of the interval of the wellbore of the hydrocarbon well to be treated.

6. The method of claim 1, further comprising:

generating an ordered ranking of the hydrocarbon wells identified as candidate wells for stimulation, wherein the hydrocarbon well to be stimulated is selected based on the ordered ranking of the hydrocarbon wells identified as candidate wells for stimulation.

7. A hydrocarbon well system comprising:

a well production system configured to operate the hydrocarbon well; and a well control system configured to perform the following operations:

determining a skin increase threshold for a given period of time;

for each of two or more hydrocarbon wells:

collecting historical production data that is indicative of observed production characteristics for the hydrocarbon well over the given period of time;

determining, based on the historical production data, a skin profile that is indicative of a change in a skin of the hydrocarbon well over the given period of time;

determining whether the change in the skin of the hydrocarbon well over the given period of time exceeds the skin increase threshold; and identifying, in response to determining that change in the skin of the hydrocarbon well over the given period of time exceeds the skin increase threshold, the hydrocarbon well as a candidate well for stimulation, wherein the skin increase threshold comprises a rate of change of skin over the given period of time, and the change in a skin of the hydrocarbon well over the given period of time comprises a rate of change of the skin of the hydrocarbon well over the given period of time;

for each of the hydrocarbon wells identified as a candidate well for stimulation:

determining an observed production flow rate for the hydrocarbon well;

determining a predicted production flow rate of the hydrocarbon well that corresponds to the hydrocarbon well having a skin of zero;

determining stimulation parameters that define parameters for a stimulation operation to remediate the wellbore of the hydrocarbon well;

determining, based on the stimulation parameters, a cost of the stimulation operation for the hydrocarbon well;

determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation;

selecting, based on the marginal production costs for the hydrocarbon wells and from the hydrocarbon wells identified as candidate wells for stimulation, a hydrocarbon well to be stimulated; and controlling the well production system to conduct the stimulation operation of the hydrocarbon well selected, wherein stimulation of the selected hydrocarbon well increases production to the predicted increase in production flow rate.

8. The system of claim 7, wherein the simulation operation of the hydrocarbon well comprises an acid injection type stimulation of the hydrocarbon well.

9. The system of claim 7, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero.

10. The system of claim 7, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero and operating at a last observed static borehole pressure.

11. The system of claim 7, wherein the stimulation parameters comprise a length of an interval of the wellbore of the hydrocarbon well to be treated, and wherein the cost of the stimulation operation for the hydrocarbon well is determined based on the length of the interval of the wellbore of the hydrocarbon well to be treated.

12. The system of claim 7, the operations further comprising:

generating an ordered ranking of the hydrocarbon wells identified as candidate wells for stimulation, wherein the hydrocarbon well to be stimulated is selected based on the ordered ranking of the hydrocarbon wells identified as candidate wells for stimulation.

13. A non-transitory computer readable storage medium comprising program instructions stored thereon that are executable by a processor to perform the following operations for developing a hydrocarbon well:

determining a skin increase threshold for a given period of time;

for each of two or more hydrocarbon wells:

collecting historical production data that is indicative of observed production characteristics for the hydrocarbon well over the given period of time;

determining, based on the historical production data, a skin profile that is indicative of a change in a skin of the hydrocarbon well over the given period of time;

determining whether the change in the skin of the hydrocarbon well over the given period of time exceeds the skin increase threshold; and identifying, in response to determining that change in the skin of the hydrocarbon well over the given period of time exceeds the skin increase threshold, the hydrocarbon well as a candidate well for stimulation, wherein the skin increase threshold comprises a rate of change of skin over the given period of time, and the change in a skin of the hydrocarbon well over the given period of time comprises a rate of change of the skin of the hydrocarbon well over the given period of time;

for each of the hydrocarbon wells identified as a candidate well for stimulation:

determining an observed production flow rate for the hydrocarbon well;

determining a predicted production flow rate of the hydrocarbon well that corresponds to the hydrocarbon well having a skin of zero;

determining stimulation parameters that define parameters for a stimulation operation to remediate the wellbore of the hydrocarbon well;

determining, based on the stimulation parameters, a cost of the stimulation operation for the hydrocarbon well;

determining, based on the observed production flow rate and the predicted production flow rate, a predicted increase in production flow rate that is attributable to the stimulation operation; and determining, based on the cost of the stimulation operation for the hydrocarbon well and the predicted increase in production flow rate that is attributable to the stimulation operation, a marginal production cost for increased production attributable to the stimulation operation;

selecting, based on the marginal production costs for the hydrocarbon wells and from the hydrocarbon wells identified as candidate wells for stimulation, a hydrocarbon well to be stimulated; and controlling a well production system to conduct the stimulation operation of the hydrocarbon well selected, wherein stimulation of the selected hydrocarbon well increases production to the predicted increase in production flow rate.

14. The medium of claim 13, wherein the simulation operation of the hydrocarbon well comprises an acid injection type stimulation of the hydrocarbon well.

15. The medium of claim 13, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero.

16. The medium of claim 13, wherein determining a predicted production flow rate of the hydrocarbon well that corresponds to the hydrocarbon well having a skin of zero comprises conducting a simulation of the hydrocarbon well based on a modeling of the hydrocarbon well with a skin of zero and operating at a last observed static borehole pressure.

17. The medium of claim 13, wherein the stimulation parameters comprise a length of an interval of the wellbore of the hydrocarbon well to be treated, and wherein the cost of the stimulation operation for the hydrocarbon well is determined based on the length of the interval of the wellbore of the hydrocarbon well to be treated.

18. The medium of claim 13, the operations further comprising:

generating an ordered ranking of the hydrocarbon wells identified as candidate wells for stimulation, wherein the hydrocarbon well to be stimulated is selected based on the ordered ranking of the hydrocarbon wells identified as candidate wells for stimulation.

* * * * *